United States Patent [19]

La Prade et al.

[11] 4,455,537

[45] Jun. 19, 1984

[54] MICROWAVE CIRCUIT INTERCONNECT SYSTEM

[75] Inventors: James N. La Prade, Dayton; Raymond S. Wondowski, Plainsboro, both of N.J.

[73] Assignee: RCA Corporation, New York, N.Y.

[21] Appl. No.: 280,919

[22] Filed: Jul. 6, 1981

[51] Int. Cl.[3] ..... H01P 5/00

[52] U.S. Cl. ..... 333/33; 333/246; 333/260

[58] Field of Search ..... 333/12, 33, 238, 246, 333/260

[56] References Cited

U.S. PATENT DOCUMENTS

| | | | |
|---|---|---|---|
| 3,155,767 | 11/1964 | Schellack . | |
| 3,218,584 | 11/1965 | Ayer | 333/246 |
| 3,270,311 | 8/1966 | Deer et al. . | |
| 3,775,644 | 11/1973 | Cotner et al. | 333/246 X |
| 3,792,383 | 2/1974 | Knappenberger . | |
| 4,143,342 | 3/1979 | Cain et al. | 333/33 |
| 4,186,358 | 1/1980 | Czech et al. | 333/238 X |
| 4,208,642 | 6/1980 | Saunders | 333/246 |

OTHER PUBLICATIONS

Stuckert, *Transmission Line Connector,* IBM Technical Disclosure Bulletin, vol. 8, No. 4, Sep. 1965, pp. 518, 519.

Comsat Technical Review, vol. 9, No. 1, Spring 1979, pp. 128–130.

*Primary Examiner*—Paul L. Gensler

*Attorney, Agent, or Firm*—Joseph S. Tripoli; George E. Haas; William Squire

[57] ABSTRACT

A plane conductive contact surface on a support member for a first microwave circuit chip is parallel and coextensive with a planar spring finger contact element of a support member for a second microwave circuit chip. The contact surface and contact element are connected to the ground planes of the respective chips. The contact element resiliently engages the conductive contact when the support members are positioned adjacent to one another. The circuit elements on the opposite surface from the ground plane on the two chips are connected to one another by a wire which is centered over the spring finger contact element and the impedance of the connection comprising the wire and spring contact closely matches the impedance of the two microwave circuit chips. The resistance at the connection between the spring finger contact element and the conductive contact surface is low.

11 Claims, 4 Drawing Figures

MICROWAVE CIRCUIT INTERCONNECT SYSTEM

The present invention relates to an interconnect coupling between planar microwave circuits.

A microwave circuit system may include various planar conductors on one surface of a thin, planar dielectric alumina substrate and a ground plane conductor at a reference potential on the opposite surface of the substrate. The characteristic impedance between the ground plane and the planar conductor should be maintained constant throughout the system. Should the characteristic impedance of one part of the system change relative to that of another, the mismatch creates voltage standing waves (VSW) and introduces undesirable losses into the system. It is desirable that the impedance variation be held to a low value to reduce the voltage standing wave ratio (VSWR) and losses to relatively low levels.

Planar microwave circuit elements on one substrate often are connected to other such circuit elements on a different substrate. The interconnection should be such that the characteristic impedances at the connection match and the VSWR is low. It is common practice to achieve this end by employing a connecting wire or link bridging the two signal circuits which is soldered in place and a conductive connecting link bridging the two ground plane conductors which also is soldered in place. The soldering minimizes interface resistance. The characteristic impedance of the connecting link is chosen to be as close as possible to the characteristic impedance of the circuits being bridged.

Other planar microwave circuit interconnections are known. One illustrated in *Comsat Technical Review*, Volume 9, No. 1, Spring 1979, at pages 128–130 comprises a gold-plated Invar (trademark for a certain high strength metal) circuit carrier, designed to match the thermal coefficient of expansion of a fused silica which forms the substrate circuit. Contact ridges beneath each input/output line provide low VSWR interfaces between circuits and provide sufficient sliding motion to accommodate thermal expansion differences between the supporting frame structure and the circuit carriers (substrates).

As shown in FIG. 6 on page 130 of the Comsat article, a first carrier on which is placed microwave integrated circuits is interconnected with a second carrier and its microwave circuits by an interconnecting wire bond link and a gold-plates soft copper bar. The latter interconnects the ground planes on the two carriers. A problem with this construction is that the soft copper bar, if compressed by the carriers, may distort somewhat. When the carriers are replaced, a new interconnect copper bar should be employed to replace the original due to the distortions in the original. This is relatively cumbersome.

When soldered interconnect links are employed to connect the ground planes, there is sometimes a problem in cases in which the substrates are mounted in a blind recess, in a supporting structure. Where a plurality of substrates and their corresponding microwave circuits need to be interconnected by soldered interconnect links, the links are not soldered between the various substrates until after the substrates are assembled into the blind recess. The solder is deposited at the interconnect joints and the interconnect link placed adjacent the joints. The substrates and links are then placed in the blind recess. After being so placed, the assembly is elevated in temperature to melt and reflow the solder, hopefully to cause the interconnect links to be soldered in place. However, solder, as is well known, does not always do the job in a satisfactory way. Because the joint is blind, that is, non-observable to a human inspector, the joint must be checked electrically, for example, for continuity. But such checks often do not detect a poor solder joint such as "cold joint" manifested by improper adhesion of the solder to the interconnect surfaces. Electrical continuity initially may be present, but the poor solder joint may eventually corrode causing joint failure. Such defects are usually best detected by direct visual observation. To solder the joints without such a visual inspection is a serious drawback.

A microwave interconnect system embodying the present invention includes first and second electrically conductive supports, each having a microwave substrate receiving surface. First and second microwave circuits are secured to the first and second supports, respectively. Each circuit includes a planar substrate, a planar ground plane on one surface of the substrate ohmically connected to its corresponding support. A microwave planar signal circuit is on the opposite surface of the substrate. One of the supports includes a resilient spring contact element on a surface of the support substantially parallel to and spaced from the substrate receiving surface of the one support. The other of the supports includes a conductive surface substantially parallel to and spaced from the substrate receiving surface of the other support. The conductive surface engages the contact element when the supports are in a given spaced position. The spring contact element and conductive surface, when engaged, form a ground plane connection between the ground plane of the first and second microwave circuits. A conductor is centered over and aligned with the spring contact element and ohmically connects the planar signal circuitry on the first microwave circuit to the planar signal circuitry on the second microwave circuit.

Figure 1:
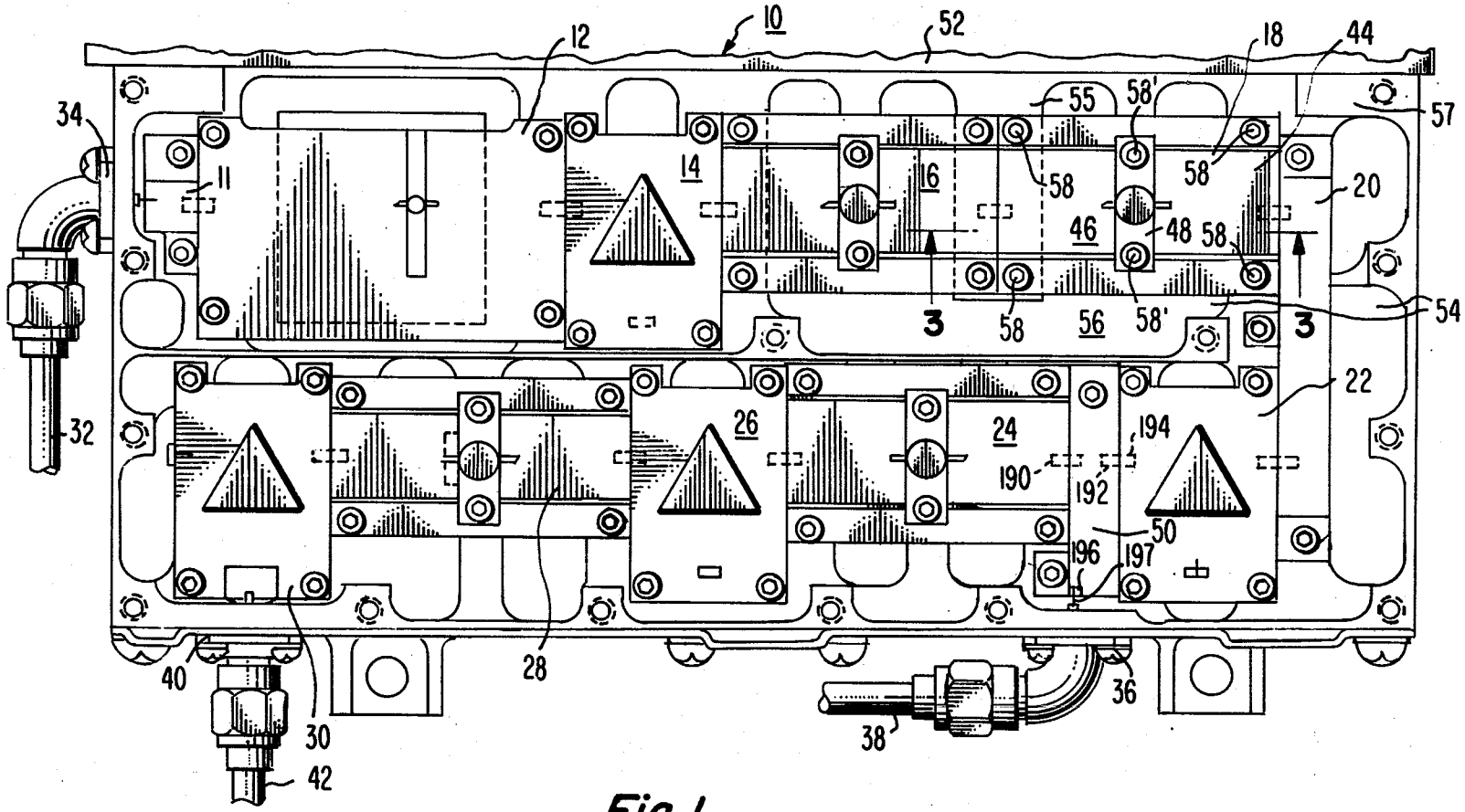
FIG. 1 is a plan view of a microwave circuit system embodying the present invention.

In FIG. 1 microwave system 10 includes a plurality of microwave substrate circuits 11, 12, 14, 16, 18, 20, 22, 24, 26, 28, and 30 which are interconnected by an interconnect arrangement, as will be described, embodying the present invention. The system 10 is coupled to an input RF (radio frequency) coaxial cable 32 by coaxial transition connector 34 which is connected to subsystem 11. The system 10 is tapped by RF transition connector 36 which is coupled to coaxial cable 38. An output transition connector 40 is coupled to the circuit 30 for supplying an output signal to coaxial cable 42. The cables 32, 38, and 42 are connected to a coaxial system, not shown. In FIG. 1 the microwave subsystems 11–30 are interconnected with a unique microwave interconnect arrangement as will be described subsequently.

Each of the subsystems 11–30 comprises a Kovar, a trademark, metal base to which is attached an alumina dielectric substrate having a metallized plane undersurface which is soldered directly to the Kovar base. The exposed surface of the alumina substrate has formed thereon a plurality of microwave plane signal circuits and components which comprise a variety of circuit elements performing different circuit functions. For example, circuit 18 comprises an output circuit 44, an input circuit 46, and an FET amplifier 48. Circuits 46 and 44 include capacitive and resistive elements and tuning means for tuning the inputs and outputs in a known manner. Also included are interconnect circuits such as circuit 50 which interconnects subsystem 22 with subsystem 24 and with the RF connector 36.

All of the circuit subsystems are mounted on a frame 52 which has a blind recess 54. Recess 54 is formed with various substrate supporting bosses, such as boss 55, and cover supporting bosses such as boss 57. Frame 52 comprises a single metal structure in which a bottom wall 56 is continuous beneath all of the subsystems. The bosses 55 and 57 extend upwardly toward the reader from wall 56. Each of the subsystems is mounted to the frame by screws 58 which are attached to the various bosses. The subsystem 18 is held in place by four screws 58. While the particular subsystems may vary in function and in shape and overall perimeter dimensions, the interconnection of each of the subsystems is similar. Therefore, a description of one subsystem interconnection is sufficient to describe the interconnection of all of the subsystems in the overall system 10. In the particular example illustrated, the overall system 10 is one employed for circuits in which the signals have frequencies in the microwave range, e.g., the gigahertz range. Such signals are impedance sensitive and the impedance at the connections between the various circuits of the subsystems is extremely critical.

Figure 2:
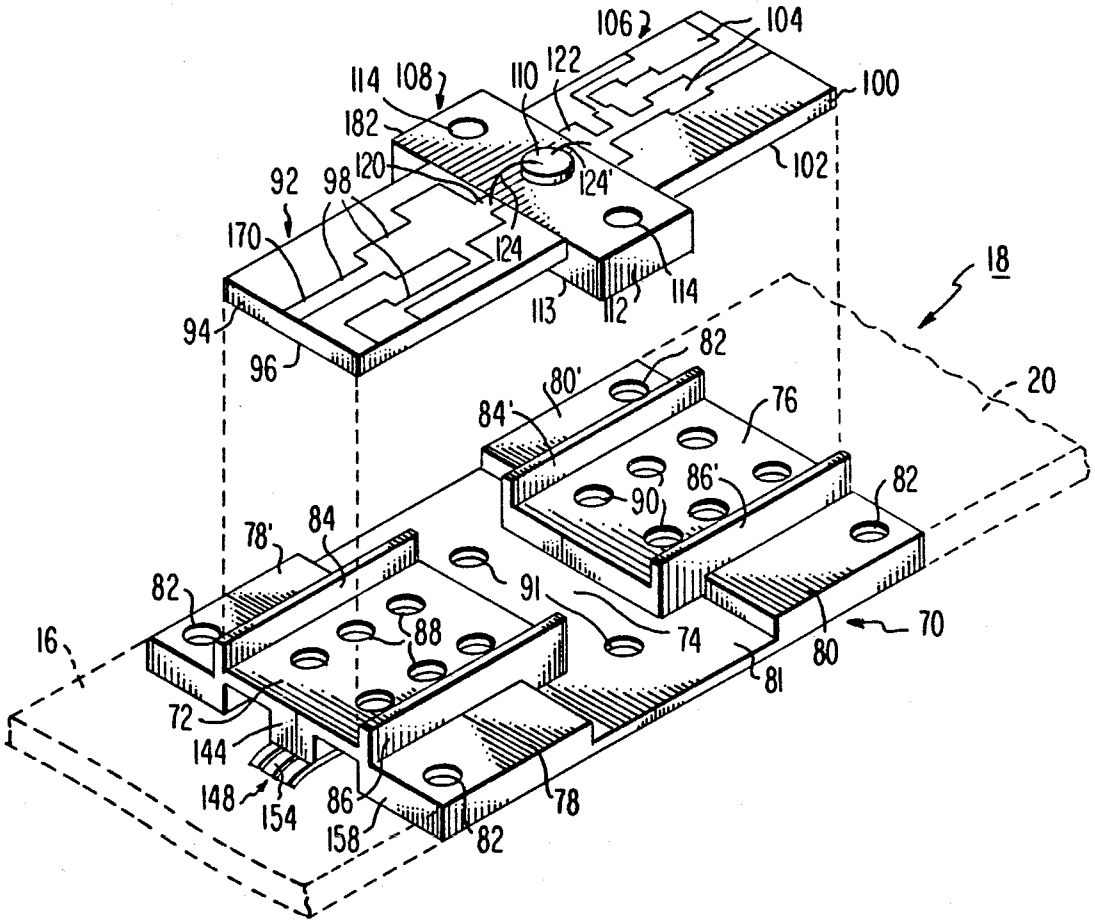
FIG. 2 is an isometric view of one of the subsystems of the system of FIG. 1.

FIG. 2 illustrates subsystem 18 which comprises a metal base 70 made of, for example, Kovar. Base 70 has a first microwave substrate receiving region 72, a second microwave substrate receiving region 74, and a third microwave substrate receiving region 76. Base 70 includes plane regions 78 and 80 separated by undercut region 81 which is coplanar with region 74 and serves to minimize weight. Regions 78' and 80' are on the opposite side of the regions 72 and 76, respectively, and are mirror images of respective regions 78 and 80. Screws 58, FIG. 1, secure base 70 to frame 52 through apertures 82. Region 72 comprises a channel having two upstanding parallel side walls 84 and 86. Region 76 has similar channel side walls 84' and 86'. Formed in the base regions 72 and 76 are a plurality of holes 88 and 90, respectively. A pair of threaded holes 91 are formed in region 74.

A microwave circuit 92 is attached to the region 72. The circuit 92 includes a dielectric substrate 94 which may be made of alumina or other dielectric material and a ground plane conductor 96 which completely covers the bottom surface of the substrate 94. A plurality of planar signal conductors 98, and circuit elements are formed on the upper surface of the substrate 94. A second microwave circuit 106 is attached to region 76. Circuit 106 includes a dielectric substrate 100 having a ground plane conductor 102 covering the entire bottom surface of the substrate and a plurality of planar signal conductors 104 and circuit elements formed on its upper surface. Amplifier 108 comprises an FET solid state amplifier 110 mounted on dielectric substrate 112. The substrate 112 has a pair of holes 114 through which screws 58', FIG. 1, pass for securing the amplifier subsystem 108 to the threaded holes 91. Substrate 112 is attached to region 74.

The circuit 92 is secured to the base region 72 by soldering the ground plane conductor 96 to the base region 72. Apertures 88 serve to receive excess solder and flux during the soldering operation. In the same way, the apertures 90 receive excess solder and flux during the soldering of the round plane conductor 102 of the subsystem 106. The amplifier 108 has a ground plane conductor 113 on the underside of the substrate 112 and is in ohmic contact with the channel region 74 of base 70. Circuit 92 serves as a tuned input to the FET amplifier 108 and the circuit 106 serves as a tuned output for the amplifier 108. These circuits are shown only by way of example, as other different circuits are present on other substrates in the subsystems 11–30. The signal conductor 120 on circuit 92 and signal conductor 122 on circuit 106 are connected to the FET amplifier 110 by wires 124 and 124', respectively, which are welded in place.

Figure 3:
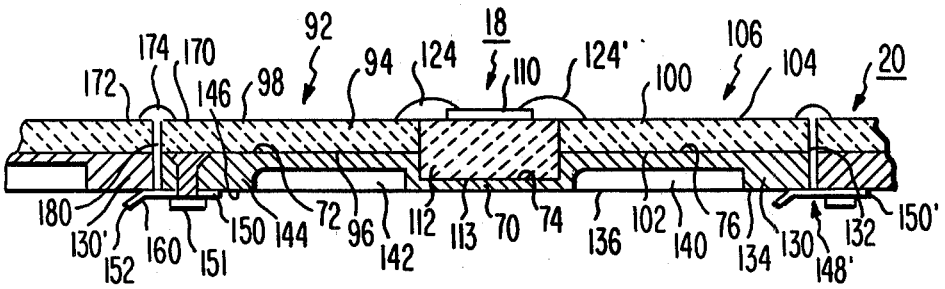
FIG. 3 is a sectional view taken along lines 3—3 of FIG. 1.
Figure 4:
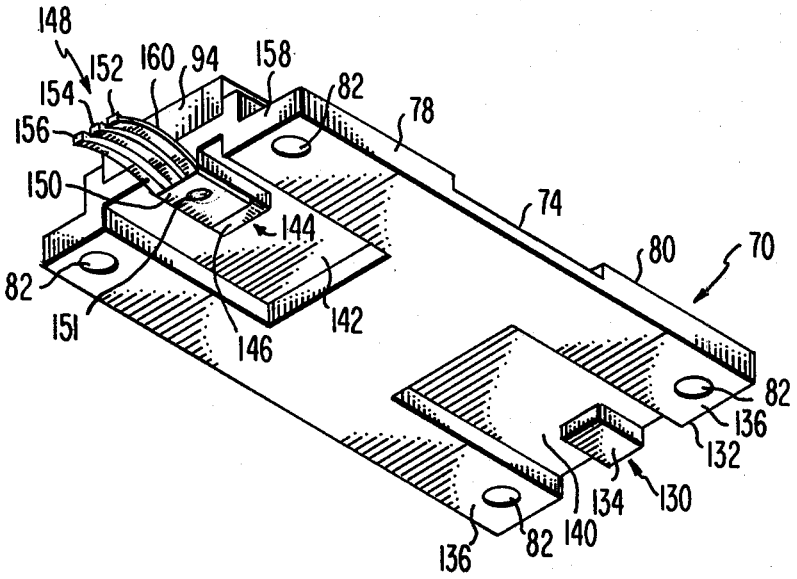
FIG. 4 is an isometric view of the underside of the structure of FIG. 2.

The subsystem 18 is connected to adjacent subsystems 20 and 16. Subsystem 20 is adjacent circuit 106 and subsystem 16 is adjacent circuit 92. It is required that the subsystem 18 be connected to the subsystems 16 and 20 with negligible impedance mismatch while providing good electrical RF connection for microwave frequencies therebetween. To do this the following structure is provided. A boss 130, FIGS. 3 and 4, is provided beneath the base region 76 and integral therewith and terminates coplanar with edge 132 of base region 76. The boss 130 has a planar bottom surface 134 which is coated with gold plate to provide a low resistance electrical contact and a corrosion resistant surface. Surface 134 is coplanar with the underside regions 136 of the base 70. A recess 140 (FIG. 4) in the base 70 surrounds the boss 134 on three sides and terminates at the end 132 of the base. A similar recess 142 is formed in the base 70 at the other end at edge 158. A boss 144 similar to boss 130 lies in recess 142. The bottom surface 146 of the boss 144 is gold plated. The surface 146 is planar and coplanar with surface 134 of boss 130. These surfaces are parallel to the ground plane conductors 96 and 102, FIG. 2.

Riveted to the gold surface 146 of boss 144 is a resilient, gold-plated beryllium spring 148. The spring 148 comprises a flat portion 150 and three fingers 152, 154, and 156 which extend beyond the edge 158. The fingers 152, 154, and 156 are preferably identical and extend from the flat portion 150 beyond edge 158 of base 70. Fingers 152, 154, and 156 are spaced from each other in the region from edge 158 to the extended ends of the fingers. The fingers are generally convex with the convex portion 160 facing upwardly, generally toward the substrate 94. Rivet 151 secures the portion 150 to the boss 144. A boss similar to boss 130 such as boss 130' on subsystem 16, FIG. 3, is present on each of the subsystems. The spring 148 is present on each of the subsystems, on an end opposite the end of the boss 130' of each subsystem 12–28. The subsystems 11 and 30 do not have a spring 148, as these subsystems are connected to the RF transition connectors in the usual way.

In FIG. 3, spring connector 148' identical to the connector 148 is secured to subsystem 20. Plane portions 150, 150' of the respective springs 148, 148' are coplanar. All of the plane portions 150 in the various subsystems are coplanar.

A portion 160 of the fingers, FIG. 3, overlaps boss 130' of subsystem 16. The overlap should be a minimum value to reduce impedance mismatch. The overlap where the spring fingers 152 make electrical contact with the boss 130' is preferably, at most, about 0.005 inch. As shown, the fingers 152 are displaced vertically by the boss 130', FIG. 3, so that the contact region of the fingers with the boss 130' is coplanar with the surface 146 of boss 144. All of the subsystems are interconnected in similar fashion as the subsystems 16, 18, and 20 of FIG. 3. All of the ground planes are coplanar.

In FIG. 3, conductor 170 is connected with conductor 172 of subsystem 16 by a connecting wire 174. The central finger 154 is directly beneath the connecting wire 174, FIG. 3. The substrate of system 16 is spaced by a gap 180, of about 5 mils, (0.005 inch) from the substrate of system 18. The center finger 154, the wire 174, and the air gap 180 have a combined impedance which closely matches that of the remainder of the circuitry. The resulting structure provides very low VSWR between the two circuits. In a similar manner, the center finger of each of the spring contacts of each of the adjacent subsystems circuits is beneath the overlying connecting link between the corresponding plane conductors.

Further, all of the bosses and connecting springs (rectangles—dashed lines) are aligned in a linear array as illustrated in FIG. 1 forming two linear parallel arrays interconnected by subsystem 20. While subsystem 18 is described by way of example as including microcircuit elements, including tuning elements, and an FET amplifier component, the interconnect system need not have such components thereon. For example, subsystem 50 comprises a set of conductors (not shown) on the exposed side of the substrate facing the viewer and interconnecting bosses and springs on the underside into the drawing such as spring contact 190 which interconnects the ground plane of subsystem 50 with the ground plane of subsystem 24. A boss 192 is contacted by spring 194 on subsystem 22. A planar electrical conductor 196 contacts the center electrode 197 of RF connector 36. The underside of the dielectric substrate of subsystem 50 has a ground plane connected to a Kovar base region. The entire assembly is screwed to frame 52.

By way of example, the conductor 170 (FIG. 2) may have a 10 mil width and the substrate 94, FIG. 2, a thickness of about 10 mils in system having a characteristic impedance of 50Ω. The center finger 154 of spring 48 is about 30 mils (0.030 inch) wide and centrally positioned under conductor 172 of system 16, FIG. 3 and under representative wire 174 which is a ribbon conductor about 1 mil thick by 25 mils wide. Spring 148 has an overall width of about 125 mils. The bosses 130, 144 (FIG. 3) are representative of the remaining bosses and are squares about 200 mils on a side. These dimensions can vary among the various subsystems and also among other systems of different impedances. Conductor 172 is also about 10 mils wide as are all the other connecting signal conductors of the other subsystems. The wider conductors may serve as electrical components such as resistors and capacitors and serve in various circuit functions. The various relationships and dimensions discussed above are not to scale in the drawing.

The interconnect system described above for connecting the various subsystems permits each of the subsystems to be assembled and disassembled from the overall system 10, FIG. 1, without disrupting, distorting, or otherwise injuring any of the other subsystems in the overall system. The wires 174, FIG. 3, interconnecting the various signal conductors between subsystems can be easily cut and removed since they are readily accessible on the exposed areas of the subsystems. The welds, because they are accessible, are also relatively easy to remove. Further, the integrity of the electrical connections between the subsystems is maintained at the ground plane connections by the releaseable spring connections. In previous systems either permanent deformation occurs when disconnecting, as discussed in the introductory part of this application, or unreliable solder connections are employed. The interconnection system of the present invention provides enhanced repeatable and reliable interconnection in a relatively blind location. Such repeatable releaseable structures permit random removal of any of the subsystems for replacement, repair, and test without deteriorating the integrity of the subsystem. Prior systems have difficulty in achieving this goal.

What is claimed is:

1. In a planar microwave circuit system including at least two subsystems, each subsystem including an electrically conductive circuit support structure, a dielectric substrate secured to the support structure, said substrate having first and second plane surfaces, the first of said surfaces being adapted to receive circuit components thereon, the second surface including planar conductor means forming a planar circuit ground plane, said ground plane being ohmically connected to said support structure, said system including connector means bridging the two subsystems including one conductor ohmically connecting said circuit components of the first surface of the two subsystems, and another conductor ohmically connecting the ground planes on the second surface of the two subsystems, the improvement comprising:

at least one electrically conductive contact receiving surface on one of said support structures ohmically connected to the ground plane on one substrate; and said another conductor comprising a resilient spring contact element on the other support structure ohmically connected to the ground plane on the other substrate and positioned to slidably, resiliently and releasably engage said contact receiving surface when the two support structures are closely adjacent one another, whereby, when so positioned, said spring contact element on one subsystem ohmically slidably, releasably engages the contact receiving surface on the adjacent subsystem support structure, to form an electrically continuous ground plane for the two subsystem circuits with negligible impedance at the connections between the two ground planes, and the parameters including size and spacing between the two conductors of the connector means being such that the connector means matches the impedance of the two subsystems it interconnects.

2. The system of claim 1 wherein said spring contact element and said contact receiving surface are coplanar when engaged.

3. The system of claim 1 wherein said contact element is aligned with the connector means bridging the subsystems to provide an impedance closely matching the impedance of the subsystems.

4. The system of claim 1 wherein said contact receiving surface comprises a plane surface parallel to the plane of the system ground plane.

5. The system of claim 1 wherein said spring contact element comprises a plurality of fingers, the central most of which is aligned with said one conductor ohmically connecting the circuit components of the two subsystems.

6. The system of claim 1 wherein said first surface has a signal conductor thereon connected to said connector means, said contact element being aligned with said signal conductor and has a width at least ten times as great as the width of the aligned signal conductor.

7. A microwave interconnect system for planar microwave circuits comprising:

first and second electrically conductive supports each having a microwave substrate receiving surface;

first and second microwave circuits secured to said first and second supports, respectively, each said circuit comprising:

a planar dielectric substrate;

a planar ground plane on one surface of said substrate ohmically connected to its corresponding support; and microwave planar signal circuitry on the opposite surface of said substrate;

one of said supports including a resilient spring contact element on a surface of said support substantially parallel to and spaced from the substrate receiving surface of the one support;

the other of said supports including a conductive surface, substantially parallel to and spaced from the substrate receiving surface of said other support, said conductive surface for engaging said contact element when said supports are in a given spaced position, said spring contact element and conductive means, when engaged, forming an electrical ground plane connection between the ground planes of the first and second microwave circuits; and a conductor centered over and aligned with the resilient spring contact element ohmically connecting the planar signal circuitry on the first microwave circuit to the planar signal circuitry on the second microwave circuit.

8. The system of claim 7 wherein said contact element comprises at least one finger which is substantially wider than said conductor centered over and aligned with the spring contact element.

9. The system of claim 7 wherein said contact element is made of gold-plated sheet beryllium metal having an engaged plane surface parallel to the ground planes of said first and second microwave circuits.

10. The system of claim 7 further including a pair of bosses, one on each of said supports, said contact receiving element surface and said conductive support surface each being formed on a different one of said bosses.

11. In a planar microwave circuit system including at least two subsystems, each subsystem including an electrically conductive circuit support structure, a dielectric substrate secured to the support structure, said substrate having first and second plane surfaces, the first of said surfaces being adapted to receive circuit components thereon, the second surface including planar conductor means forming a planar circuit ground plane, said ground plane being ohmically connected to said support structure, said system including connector means bridging the two subsystems including one conductor ohmically connecting said circuit components of the first surface of the two subsystems, and another conductor ohmically connecting the ground planes on the second surface of the two subsystems, the improvement comprising:

at least one electrically conductive contact receiving surface on one of said support structures ohmically connected to the ground plane on one substrate; and said another conductor comprising a resilient spring contact element on the other support structure ohmically connected to the ground plane on the other substrate and positioned to engage said contact receiving surface when the two support structures are closely adjacent one another, whereby, when so positioned, said spring contact element on one subsystem ohmically engages the contact receiving surface on the adjacent subsystem support structure, to form an electrically continuous ground plane for the two subsystem circuits with negligible impedance at the connections between the two ground planes, and the parameters including size and spacing between the two conductors of the connector means being such that the connector means matches the impedance of the two subsystems it interconnects, said spring contact element comprising a plurality of fingers, the central most of which is aligned with said one conductor ohmically connecting the circuit components of the two subsystems.

* * * * *